United States Patent [19]

Williamson et al.

[11] 4,421,249

[45] Dec. 20, 1983

[54] APPARATUS FOR DISPENSING FLUIDS

[75] Inventors: Audley B. Williamson; Stewart Banks; Francis J. Rice, all of Derby, England

[73] Assignee: Appor Limited, Derby, England

[21] Appl. No.: 249,325

[22] Filed: Mar. 31, 1981

[30] Foreign Application Priority Data

Apr. 2, 1980 [GB] United Kingdom ..... 8011066

[51] Int. Cl.[3] ..... B67B 7/28

[52] U.S. Cl. ..... 222/88; 222/154

[58] Field of Search ..... 222/81, 83, 154, 158, 222/83.5, 88, 105, 89, 91; 220/94 A; 215/100 A

[56] References Cited

U.S. PATENT DOCUMENTS

| | | | |
|---|---|---|---|
| 1,544,922 | 7/1925 | Midgley, Jr. | 222/88 |
| 3,434,629 | 3/1969 | Hooge et al. | 222/88 |
| 3,762,606 | 10/1973 | Lande | 222/88 |
| 3,926,341 | 12/1975 | Lhoest | 215/100 A |
| 4,316,555 | 2/1982 | Smith | 222/83.5 |
| 4,322,019 | 3/1982 | Smith | 222/83.5 |

*Primary Examiner*—Stanley H. Tollberg
*Attorney, Agent, or Firm*—Alan H. Levine

[57] ABSTRACT

A dispenser comprises a hollow body adapted to receive a container of product to be dispensed, a dispensing mechanism disposed below the hollow body and means within the body for puncturing a container of product inserted therein to permit discharge of product from the container into the lower portion of the body. The lower portion of the body defines a reservoir of smaller volume than that of the container whereby the product accumulated in the reservoir acts to seal the punctured container and control the discharge of product therefrom. The container and the body are of complementary shape so that the container may only be inserted into the body in one position.

6 Claims, 1 Drawing Figure

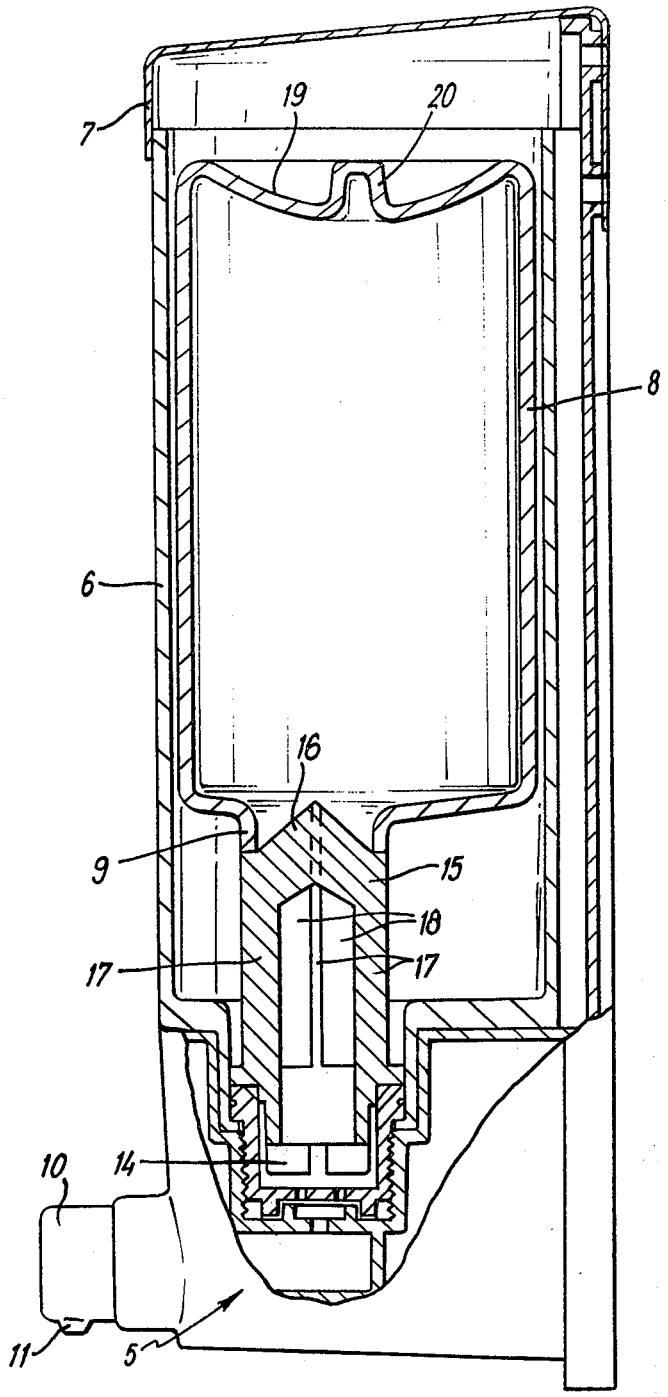
7
19
20
8
6
16
9
15
18
17
17
10
14
11
5

APPARATUS FOR DISPENSING FLUIDS

The invention relates to dispensers.

Manually operated dispensers for liquid soap, hand cleansers and the like conventionally take one of two forms. One form comprises a dispensing mechanism and an integral container for the product to be dispensed, the container being refilled with the product periodically from stock when it becomes empty. The other form of dispenser comprises a dispensing mechanism to which a separate container of product to be dispensed can be fitted. In this case when the product is exhausted the container is detached and a fresh container containing further product is fitted to the dispenser.

A disadvantage of the first type of dispenser is that it is necessary to maintain a separate bulk stock of the product to be dispensed and filling the container from this stock is inconvenient and often results in spillage of the product. The second type of dispenser is more convenient in that refilling simply involves substitution of a fresh container of the product, but this type of dispenser suffers from the disadvantage that replenishment is only possible when the product is completely exhausted and removal and replacement of the container frequently results in spillage of the product. Moreover, this type of dispenser is subject to leakage at the connection between the container and the dispensing mechanism and complex and relatively expensive seals are therefore required to prevent this.

It is an object of the present invention to provide a dispenser in which some or all of these disadvantages are obviated or mitigated.

The invention provides a dispenser comprising a hollow body adapted to receive a container of product to be dispensed, a dispensing mechanism disposed below the hollow body and means within the body for puncturing a container of product inserted therein to permit discharge of product from the container into the lower portion of the body.

The means for puncturing the container may comprise an upwardly directed projection having a point for piercing the container, the projection being hollow and openings being provided which communicate with the interior of the projection and permit product released from the container following puncturing to pass into the lower portion of the dispenser body.

Preferably the container is provided with a temporarily sealed outlet opening in a position adapted to be engaged by said projection when the container is inserted into the dispenser body, the opening preferably being sealed by a readily pierceable material such as metal foil.

Preferably also the container and the body are of complementary shape so that the container may only be inserted into the body in one position, the container also being formed with means on its underside, which will be uppermost in use, to facilitate withdrawal of the container from the body when the container is empty.

An embodiment of the invention will now be described, by way of example only, with reference to the accompanying drawing which is a vertical cross-section through one form of dispenser according to the invention.

Referring to the drawing, the dispenser includes a dispensing mechanism 5 surmounted by a hollow body 6 having a lid 7 giving access to the body. The body is adapted to receive a container 8 of liquid soap or other product to be dispensed which has an outlet 9 and is inserted in the body in an inverted position with the outlet directed downwardly.

The dispensing mechanism itself may be of known form comprising a plunger 10 and suitable one-way valve means arranged such that operation of the plunger dispenses a charge of product contained in the dispensing mechanism and draws in a further charge of product from the body of the dispenser. A discharge opening 11 is provided in the plunger such that when the user depresses the plunger a predetermined quantity of product is discharged into his hand and the plunger is then restored under spring action to its initial position ready for subsequent use.

An inlet opening 14 is provided in the upper surface of the dispensing mechanism 5 to permit entry of product from the dispenser body and a hollow post 15 surrounds and extends upwardly from the inlet opening and terminates in a spike 16. The post comprises four circumferentially disposed arms 17 separated by openings 18 which permit flow of product through the interior of the post from the container 8 to the dispenser body 6 and from the dispenser body to the dispensing mechanism.

The container comprises a bottle preferably formed from a suitable plastics material, having an outlet or neck 9 which serves as an inlet for filling purposes and as an outlet when the container is inverted in the dispenser body. The under side of the container (which is uppermost in use) is provided with a depression 19 traversed by a projection 20 which facilitates gripping of the container for removal from the body when empty. After filling of the container by the supplier of the soap or other product to be dispensed, the neck 9 is sealed by a membrane of metal foil and the container is supplied to the customer in this temporarily sealed form. When the customer requires to replenish his dispenser he inverts the container and introduces it into the body 6 so that the fail seal impinges on the spike 16 and is pierced thereby allowing the contents of the container to flow into the bottom of the dispenser body 6.

A particular advantage of the arrangement described is that it is self-sealing in so far as the soap or other product flows out of the container 8 after piercing and fills the bottom of the dispenser body 6 to a level just above the container outlet 9. At this point the liquid seals the outlet from the container and, since the container is inverted prevents further flow of product so that a reservoir of the product is formed in the bottom of the dispenser body from which it passes to the dispensing mechanism as the dispenser is used. The problem of spillage is therefore eliminated since the container is sealed when inserted into the dispenser body and once pierced the level of product cannot rise above the container outlet and is therefore confined to the lower region of the dispenser body. Moreover, if the dispenser body or the lower region thereof is transparent the product in this lower region is visible and this gives a visual indication when the dispenser requires replenishing. In normal use the level of product in the body will remain constant but once the container is empty the level will start to fall as the product is dispensed. The empty container can then be removed and replaced by a new full container.

Various modifications may be made without departing from the invention. For example alternative means of sealing and piercing the container may be employed and the dispensing mechanism may take any convenient form. The apparatus may, of course, be used for dispensing any products in liquid, paste, powder or gel form, soap cleaning preparations and skin creams merely being examples.

We claim:

1. A dispenser comprising a hollow body defining an internal cavity in which a container of product to be dispensed can be removably located, a dispensing mechanism disposed below the hollow body, and means within the body for puncturing a container of product inserted therein so as to form an outlet for discharge of product from the container via the puncturing means to the dispensing mechanism, wherein the puncturing means also defines the path for passage of product between the puncturing means and the lower portion of said cavity to form a reservoir of product of predetermined capacity in the latter, said means for puncturing the container comprising an upwardly directed projection having a point for piercing the container, the projection being hollow and openings being provided to define said path which permits product released from the container following puncturing to pass into the lower portion of the cavity, and the container being supported within the cavity by the projection, a lower portion of the hollow body being formed so as to enable viewing of said product forming said reservoir in said lower portion of said cavity from externally of the dispenser, said path enabling product to be supplied to said dispensing mechanism from said reservoir when said container is empty of product, the capacity of the reservoir enabling removal and replacement of the container before the product is exhausted from the dispenser.

2. A dispenser according to claim 1 wherein the container is provided with a temporarily sealed outlet opening in a position adapted to be engaged by said projection when the container is inserted into the dispenser body.

3. A dispenser according to claim 1 wherein the container and the cavity are of complementary shape so that the container may only be inserted into the body in one position.

4. A dispenser according to claim 1 wherein the container is provided with means on its underside to facilitate withdrawal of the inverted container from the body when the container is empty.

5. A dispenser according to claim 1 wherein at least the lower region of said body is transparent.

6. A dispenser according to any of claim 1 wherein the container is formed of a rigid plastics material.

* * * * *